US006196540B1

(12) United States Patent
Schmid et al.

(10) Patent No.: US 6,196,540 B1
(45) Date of Patent: Mar. 6, 2001

(54) BLOW TUBE FOR A SHEET-STACKING APPARATUS

(75) Inventors: Frank Schmid, Krefeld; Jürgen Menzel, Ratingen, both of (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/103,186

(22) Filed: Jun. 23, 1998

(30) Foreign Application Priority Data

Jul. 17, 1997 (DE) ..... 197 30 586

(51) Int. Cl.[7] ..... B65H 31/10

(52) U.S. Cl. ..... 271/177; 271/216; 271/217; 271/195

(58) Field of Search ..... 271/216, 217, 271/302, 177, 195

(56) References Cited

U.S. PATENT DOCUMENTS 4,197,621 * 4/1980 Mair ..... 271/195
4,221,377 * 9/1980 Bodewein et al. ..... 271/216
4,625,956 * 12/1986 Marass et al. ..... 271/309
4,956,936 * 9/1990 Sprung ..... 47/17
5,628,505 * 5/1997 Voss .
5,672,045 * 9/1997 Schmid .
5,681,038 * 10/1997 Kollann .
5,693,217 * 12/1997 Erdmannsdoerfer et al. ..... 210/97

FOREIGN PATENT DOCUMENTS 0 056 924 * 8/1982 (EP) .

* cited by examiner

*Primary Examiner*—Christopher P. Ellis
*Assistant Examiner*—Mark A. Deuble
(74) *Attorney, Agent, or Firm*—Herbert Dubno; Andrew Wilford

(57) ABSTRACT

A sheet-stacking apparatus has a conveyor including a plurality of parallel upper belts extending in a transport direction for delivering a succession of sheets one at a time to a stacking station and a plurality of blow tubes each having a main portion extending in the direction. The main portions are interleaved with the upper belts and are each formed with a plurality of downwardly open holes. Respective tubular rivet bodies set in the holes have heads bearing upward against the respective tube main portions and form downwardly open nozzles. Interiors of the tubes can be pressurized with air to project jets of air downward from the nozzles of the tube main portions.

6 Claims, 3 Drawing Sheets

BLOW TUBE FOR A SHEET-STACKING APPARATUS

FIELD OF THE INVENTION

The present invention relates to an apparatus for stacking sheets. More particularly this invention concerns a blow tube used for separating sheets in an apparatus that receives sheets, normally of paper, one at a time and stacks them up on pallets.

BACKGROUND OF THE INVENTION

Paper sheets are produced from a continuous strip whose longitudinal edges are trimmed and that is then transversely cut into a succession of the sheets that are delivered one at a time one immediately after the other to a stacking apparatus of the type described in commonly owned U.S. Pat. No. 5,628,505 of Voss, U.S. Pat. No. 5,672,045 of Schmid, and U.S. Pat. No. 5,681,038 of Kollann. Such a stacking apparatus typically has a vertically displaceable platform on which is supported a pallet. The sheets are delivered by a conveyor to the stacking apparatus to form a stack on the pallet, which is lowered as the stack height increases so that each sheet has only to drop a minimal distance before coming to rest on top of the stack.

Each sheet is gripped upstream of the station between a lower belt or a group of parallel lower belts and a group of upper belts, but of course the lower belt ends at the input side of the station so that the sheets can drop downward. The upper belts normally therefore extend through the station and serve significantly to guide and position the incoming sheets.

In order to ensure clean separation of the sheets from the upper belts it is standard to provide one or more blow tubes. Such systems are described in East German patent 111,870 of Pretzsch, German patent 2,755,160 of Bodewein (U.S. equivalent 4,221,377), German patent document 3,323,052 of Henkenhaf, German patent 4,012,943 of Vits, Swiss patent 637,090 of Bodewein, and European 0,056,924 of Fitzparick. The blow tubes generally are simple tubes extending in the transport direction between the upper belts and formed with downwardly open holes from which respective jets of air are directed at the upper face of the sheets to push them down off the upper belts onto the stack.

As a rule these blow tubes are fairly expensive items to manufacture. They must be carefully shaped and the nozzle holes must be carefully formed. If nozzle fittings are provided to focus the jets, they must be constructed such that the leading edge of the incoming sheet does not catch on them. As a result blow tubes are a significant investment. Furthermore they are difficult to change or replace in the event of a format change in the sheets requiring a shorter or longer tube, so that one is often inclined to use overlong tubes that result in waste of air pressure and premature separation of the sheets from the upper conveyor belts.

OBJECTS OF THE INVENTION

It is therefore an object of the present invention to provide an improved blow tube for a sheet-stacking apparatus.

Another object is the provision of such an improved blow tube for a sheet-stacking apparatus which overcomes the above-given disadvantages, that is which is of simple and inexpensive construction, yet which performs as well as or better than the more expensive prior-art blow tubes.

SUMMARY OF THE INVENTION

A sheet-stacking apparatus has according to the invention a conveyor including a plurality of parallel upper belts extending in a transport direction for delivering a succession of sheets one at a time to a stacking station and a plurality of blow tubes each having a main portion extending in the direction. The main portions are interleaved with the upper belts and are each formed with a plurality of downwardly open holes. Respective tubular rivet bodies set in the holes have heads bearing upward against the respective tube main portions and form downwardly open nozzles. Interiors of the tubes can be pressurized with air to project jets of air downward from the nozzles of the tube main portions.

Such a blow tube can be made extremely easily and cheaply. The tube itself is drilled out and then the holes are each fitted with a standard so-called pop rivet. Such a rivet, which is according to the invention at least 2 mm long and preferably between 5 mm to 7 mm, forms a simple nozzle that directs a focussed jet of air down at the sheet underneath it. The tube can be produced on a simple bending jig and can in fact be made up right at the site easily, and the pop-rivet nozzles can be fitted to it with standard hand tools.

The rivet heads in accordance with the invention are flat and rounded, that is they fit tightly to the outer surface of the tube but have a rounded or so-called button shape so that the incoming sheets will not catch on them.

Each tube according to the invention includes a connecting portion provided on its end with a snap-coupling half. The pressurizing system includes a horizontal manifold with a plurality of snap-coupling halves matable with the respective snap-coupling halves of the connecting portions. Thus the tubes can easily be removed and replaced. In addition the connecting portion is an inverted J-shaped and has a short vertical portion having a lower end provided with the respective snap-coupling half and a long vertical portion having a lower end from which the respective main portion extends horizontally with an inverted U-shaped bight portion joining the two vertical portions.

The stacking apparatus further has a platform in the station adapted to receive the sheets and movable between an upper and a lower position. The blow tubes are above the upper position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
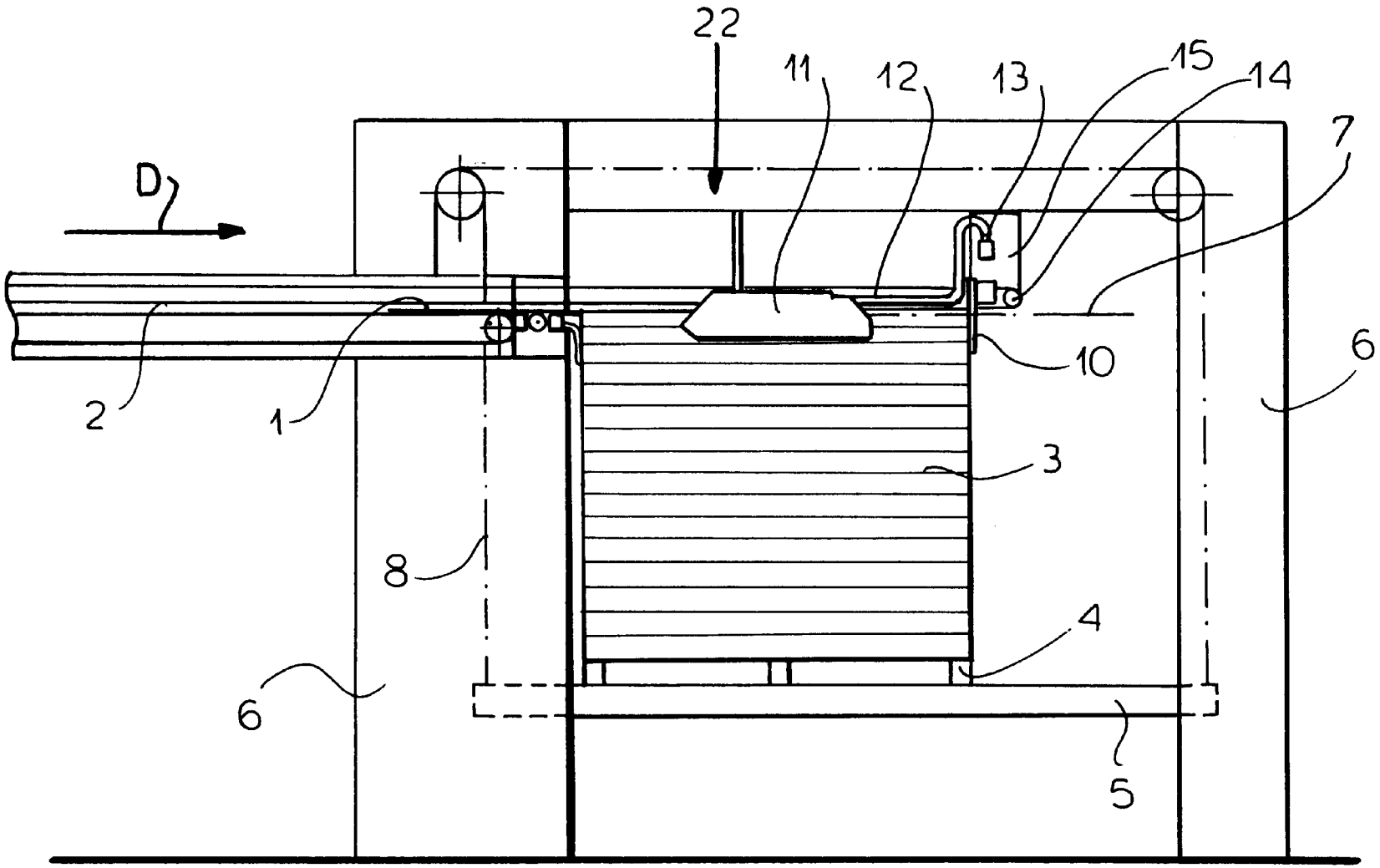
FIG. 1 is a small-scale side view of a sheet-stacking apparatus according to the invention.

As seen in FIG. 1 a succession of large cardboard sheets 1 are delivered by a conveyor 2 to a sheet-stacking station 22 where they are formed into a stack 3 on a pallet 4. The pallet 4 sits on a vertically movable floor 5 in order that as the stack 3 is being formed the pallet 4 can be moved vertically so that the sheets 1 do not have to drop too far before they land on the pallet 4. To this end, cables 8 connected to the floor panel 5 extend up a machine frame 6 and are connected to an unillustrated actuator that allows the floor panel 5 to be lowered synchronously as the stack 3 is formed, with the top of the stack 3 being only slightly below a delivery plane 7 of the input conveyor 2. A vertical plate 10 extending perpendicular to a sheet transport direction D defines the downstream end of the station 22 against which the sheets 1 engage when they come to a stop and two vertical side guide plates 11 extending in the direction flank the station 22 to ensure proper vertical side-to-side alignment of the sheets 1 in the stack 3. A slide 15 movable horizontally in the frame 6 allows the plate 10 to be adjusted for workpieces 1 of different lengths.

A plurality of upper belts 9 extending in the direction D have lower stretches that extend upstream of the station 22 parallel to the lower conveyor 2 to grip and guide the sheets 1 therewith, and in the station 22 they extend parallel to one another the full length of the station 22, being spanned at downstream ends over rollers 14 that are mounted on the slide and themselves are downstream in the direction D from the plate 10.

Figure 2:
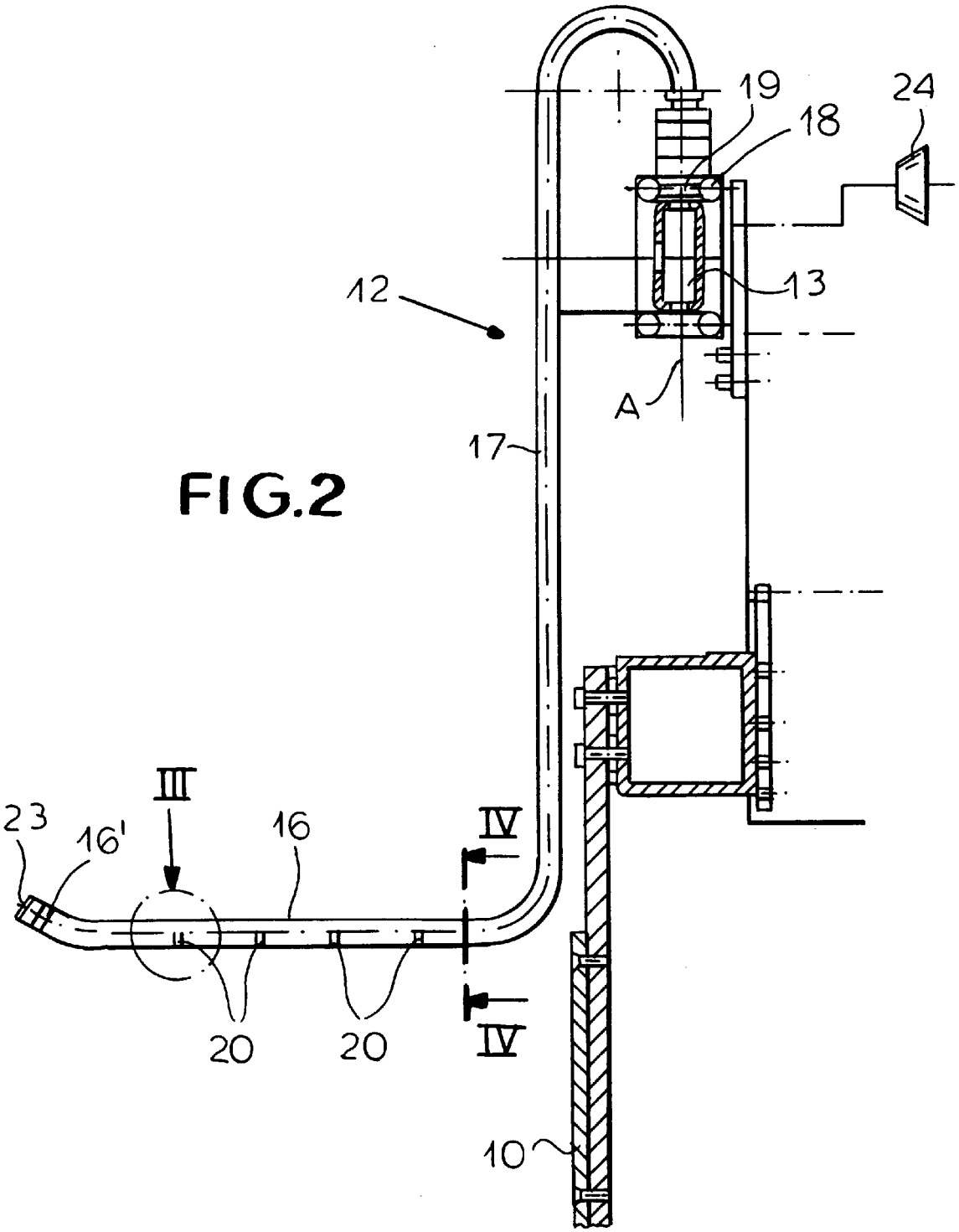
FIG. 2 is a larger-scale and partly sectional view of a detail of the apparatus with a blow tube.
Figure 3:
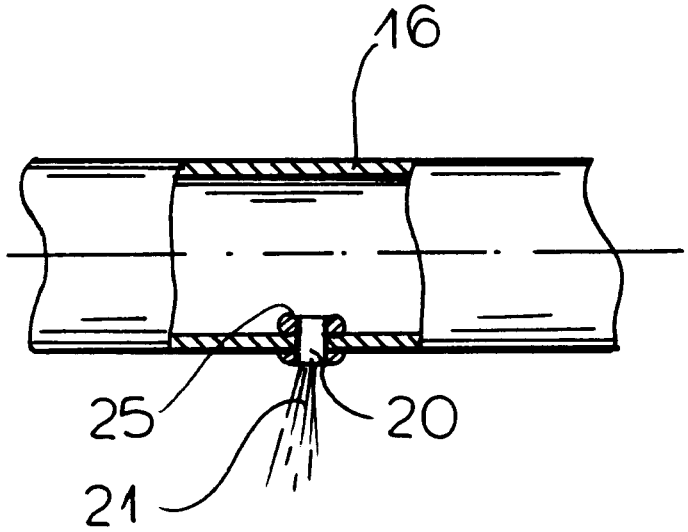
FIG. 3 is a large-scale sectional view of the detail indicated at III in FIG. 2.
Figure 4:
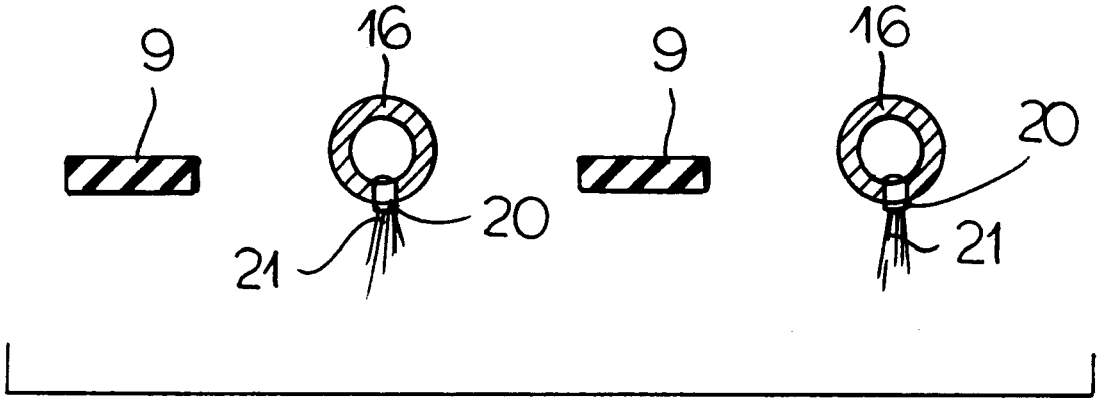
FIG. 4 is a cross section corresponding generally to line IV—IV of FIG. 2.

According to the invention as shown in FIGS. 2 through 4, a plurality of identical blow tubes 12 are provided in the station 22 to force the sheets 1 down off the upper belts 9, to which they often tend to adhere somewhat. Each such blow tube 12 comprises a horizontal main section 16 having an uplifted front end 16' closed with a cap 23 and a J-shaped riser part 17 whose end is provided with a fitting 19 received in a quick-release coupling 18 of a manifold 13 mounted on the slide 15 and supplied with compressed air from a blower 24.

The main portion 16 of each such tube 12 extends in the direction D and is provided with a plurality of downwardly directed nozzles 20 forming respective downwardly directed jets 21 of pressurized air. According to the invention the nozzles 20 are formed as simple button-head rivets of the so-called "pop" type. Such a rivet has a tubular body formed on one end with a flange that eventually forms the rivet head and is provided with a mandrel pin that projects from the flange end and that has on the other end of the rivet an enlarged head. This rivet is set through a hole 25 in the workpiece, here the tube portion 16, and its mandrel pin is pulled outward to upset the rear end of the rivet until the pin breaks, whereupon the broken end normally drops off or can be poked out of the rivet, leaving a neat tubular hole. The broken mandrel end can easily be shaken out of the end of the tube 12.

In accordance with the invention each tube 12 is about 20 mm in diameter and has a wall thickness of 1.5 mm. Each such portion 16 has five such rivet nozzles 20 spaced some 60 mm apart. The rivets are set in holes 3 mm to 4 mm in diameter, and the axial length of each such rivet nozzle 20 is at least 2 mm, preferably 5 mm to 7 mm.

Each of the snap couplings 16 is centered on a vertical axis A so that it is a relatively easy job to release the coupling 18 of a tube 12 to be replaced, lift out the old tube, and set a new such tube in place.

We claim:

1. In a sheet-stacking apparatus comprising a conveyor including a plurality of parallel upper belts extending in a transport direction for delivering a succession of sheets one at a time to a stacking station, the improvement comprising:

a plurality of blow tubes each having a main portion extending in the direction, the main portions being interleaved with the upper belts and each formed with a plurality of downwardly open holes;

respective tubular rivet bodies set in the holes, having heads bearing upward against the respective tube main portions, and forming downwardly open nozzles; and means for pressurizing interiors of the tubes with air and thereby projecting jets of air downward from the nozzles of the tube main portions.

2. The stacking-apparatus improvement defined in claim 1 wherein the tubular rivet bodies have a length of 5 mm to 7 mm.

3. The stacking-apparatus improvement defined in claim 1 wherein the rivet heads are flat and rounded.

4. The stacking-apparatus improvement defined in claim 1 wherein each tube includes a connecting portion provided on its end with a snap-coupling half, the means for pressurizing including a horizontal manifold with a plurality of snap-coupling halves matable with the respective snap-coupling halves of the connecting portions.

5. The stacking-apparatus improvement defined in claim 1 wherein the apparatus further has a platform in the station adapted to receive the sheets and movable between an upper and a lower position, the blow tubes being above the upper position.

6. In a sheet-stacking apparatus comprising a conveyor including a plurality of parallel upper belts extending in a horizontal transport direction for delivering a succession of sheets one at a time to a stacking station, the improvement comprising:

a plurality of blow tubes each having a main portion extending in the direction and a J-shaped connecting portion, the main portions being interleaved with the upper belts and each formed with a plurality of downwardly open holes, the J-shaped connecting portions each having a short vertical portion having a lower end provided with a respective snap-coupling half and a long vertical portion having a lower end from which the respective main portion extends horizontally;

respective tubular rivet bodies set in the holes, having heads bearing upward against the respective tube main portions, and forming downwardly open nozzles; and means including a horizontal manifold and a plurality of snap-coupling halves matable with the respective snap-coupling halves of the connecting portions for pressurizing interiors of the tubes and thereby projecting lets of air downward from the nozzles of the tube main portions.

* * * * *